US006160766A

United States Patent [19]

Chiang

[11] Patent Number: 6,160,766

[45] Date of Patent: Dec. 12, 2000

[54] CALENDAR INDICATOR

[76] Inventor: Chi Sheng Chiang, 515 N. Chandler Ave., #C, Monterey Park, Calif. 91754

[21] Appl. No.: 09/182,315

[22] Filed: Oct. 30, 1998

[51] Int. Cl.[7] ..... G04B 19/20

[52] U.S. Cl. ..... 368/37; 40/115; 368/28

[58] Field of Search ..... 368/28, 37; 40/115

[56] References Cited

U.S. PATENT DOCUMENTS

| | | | |
|---|---|---|---|
| 2,136,490 | 11/1938 | cohen | 40/115 |
| 2,411,185 | 11/1946 | bernstein | 40/115 |
| 2,519,188 | 8/1950 | hossu | 40/110 |
| 4,026,052 | 5/1977 | ando | 40/115 |

*Primary Examiner*—Bernard Roskoski
*Attorney, Agent, or Firm*—Raymond Y. Chan; David and Raymond

[57] ABSTRACT

A calendar indicator includes a date disc, a week disc and an indicator member. The date disc is equally divided into 28 date indicating segments. The date disc further has 28 numerals, from "1" to "28", respectively provided in sequence on the 28 date indicating segments of the 28 date sectors. The three adjacent date indicating segments having the numerals "1", "2" and "3" provided thereon respectively form a first, a second and a third sub-segment. Three numerals including "29", "30" and "31" are respectively provided on the first, second and third sub-segments. The week disc which is coaxially and rotatably mounted on the date disc is equally divided into 28 week indicating segments. The indicating member is rotatably mounted on the week disc for indicating what date and day of week is today. Whereby the user may easily find out what day is today and the day of week of today from the calendar indicator of the present invention.

22 Claims, 7 Drawing Sheets

CALENDAR INDICATOR

FIELD OF THE PRESENT INVENTION

The present invention relates to calendar, and more particularly to a calendar indicator which can precisely and simultaneously indicate both the date and the day of week of every month in a year.

BACKGROUND OF THE PRESENT INVENTION

Calendar is the most common daily tool that everybody uses to find out what day is today. Conventional calendar mainly comprises two types. The first type is monthly, which generally provides 12 sheets of monthly calendar paper each represents a particular month within a year and has the days of that month printed thereon. The second type is daily calendar that has 365 pieces of daily calendar paper each represents a particular day calendar in that year.

The drawback of the monthly calendar is that, although it can provide the reference of the day of week for each day in a month, the user is still unable to find out what day is today from such monthly calendar if he or she fails to remember what day is yesterday. The daily calendar can solve the shortcoming of the monthly calendar by providing 365 pieces of paper for the 365 days within a year respectively. The user may simply tear off a piece of daily calendar paper every day, and then the day of today is indicated on the frontmost piece of daily calendar paper. The user can precisely observe the day of today easily. However, in view of the environment protection, the daily calendar is substantially a waste of paper which is normally made of timber tissue.

SUMMARY OF THE PRESENT INVENTION

Accordingly, it is thus a first object of the present invention to provide a calendar indicator, which simply comprises as less as two to three calendar indicators that, however, can precisely indicate the date and the day of the week of a particular month within a year at the same time.

A further object of the present invention is to provide a calendar indicator wherein the user does not need to tear off any paper per day or per month so as to meet the environment protecting purpose.

Another object of the present invention is to provide a calendar indicator which operation is easy and simple that, the user merely needs to adjust the day of week once per month and move the indicator member for one sector every day.

Yet another object of the present invention is to provide a calendar indicator which can be equipped with a time equipment for automatically driving the indicator member of the present invention to move to indicate the exact date and day of week every day.

Still another object of the present invention is to provide a calendar indicator which can be equipped with a clock so as to indicate the current time and the date and day of week of today at the same time.

Accordingly, in order to accomplish the above objects, the present invention provides a calendar indicator, which comprises a date disc, a week disc and an indicator member.

The date disc is equally divided into 28 date sectors, wherein each of the date sectors has an outer portion forming a date indicating segment. The date disc further has 28 numerals, from "1" to "28", respectively provided in sequence on the 28 date indicating segments of the 28 date sectors. The three adjacent date indicating segments having the numerals "1", "2" and "3" provided thereon respectively form a first, a second and a third sub-segment. Three numerals including "29", "30" and "31" are respectively provided on the first, second and third sub-segments. The date disc further has a month indicator extended therefrom for indicating a particular month of a year.

The week disc is coaxially and rotatably mounted on the date disc and has a size smaller than the date disc so as to enable the 28 date indicating segments aligned along a periphery edge of the week disc with respect to the corresponding week indicating segment. The week disc is equally divided into 28 week sectors. Each of the week sectors has an outer portion forming a week indicating segment. In other words, 4 week segment sets each containing seven adjacent week indicating segments are provided. Seven days of a week, including "Sunday", "Monday", "Tuesday", "Wednesday", "Thursday", "Friday", and "Saturday", are respectively provided on the seven week indicating segments of each of the week segment sets.

The indicating member is rotatably mounted on the week disc for indicating what date and day of week is today. Whereby the user may easily find out what day is today and the day of week of today from the calendar indicator of the present invention.

The calendar indicator may also equipped with a time equipment which is adapted for automatically driving the indicating member to move for 1/28 circular every day. Besides, the calendar indicator may also equipped with a clock so as to indicate the current time at the same time.

DETAILED DESCRIPTION OF THE PREFERRED EMBODIMENTS

Figure 1:
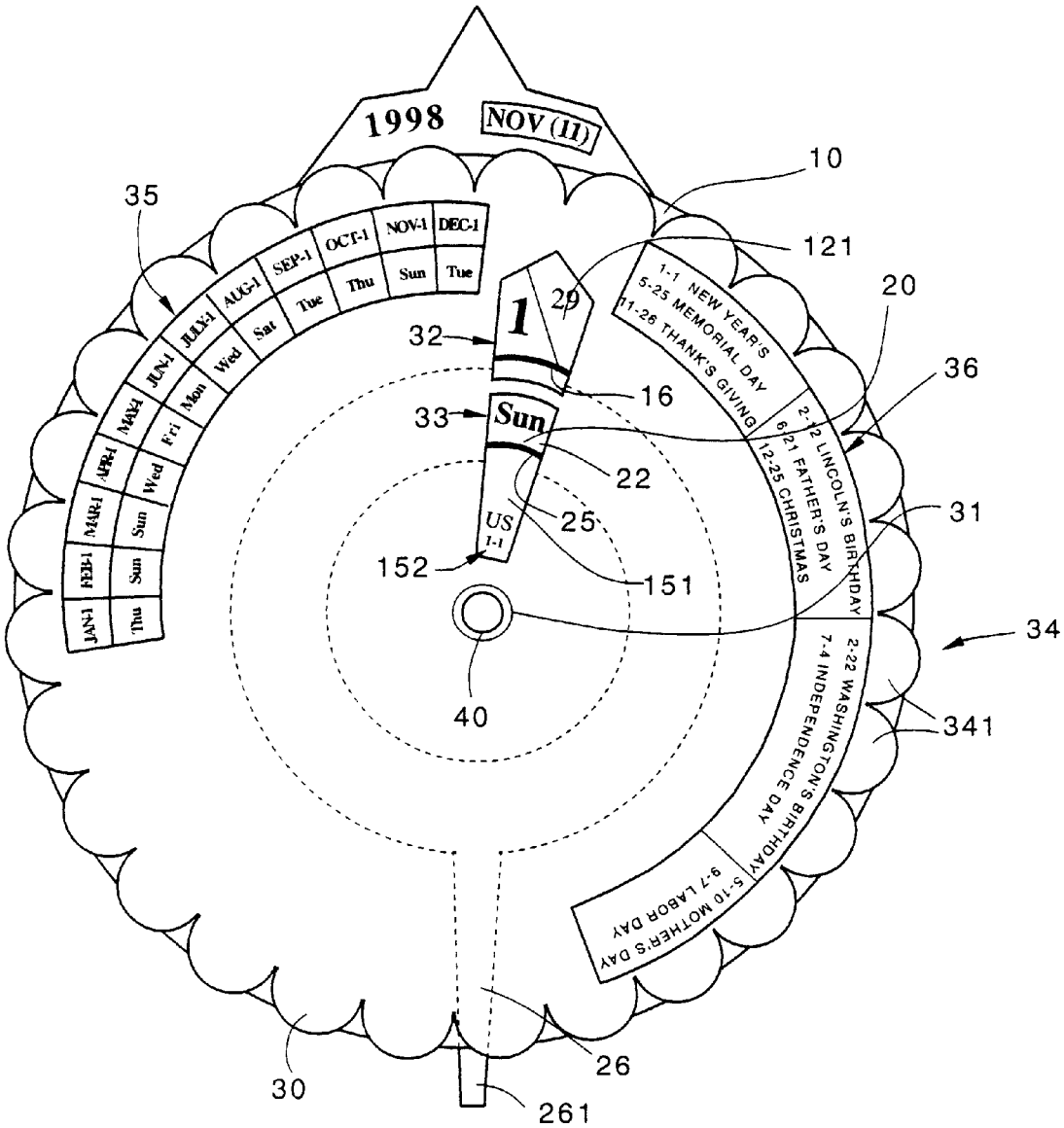
FIG. 1 is a front view of a calendar indicator in accordance with a preferred embodiment of the present invention.
Figure 2:
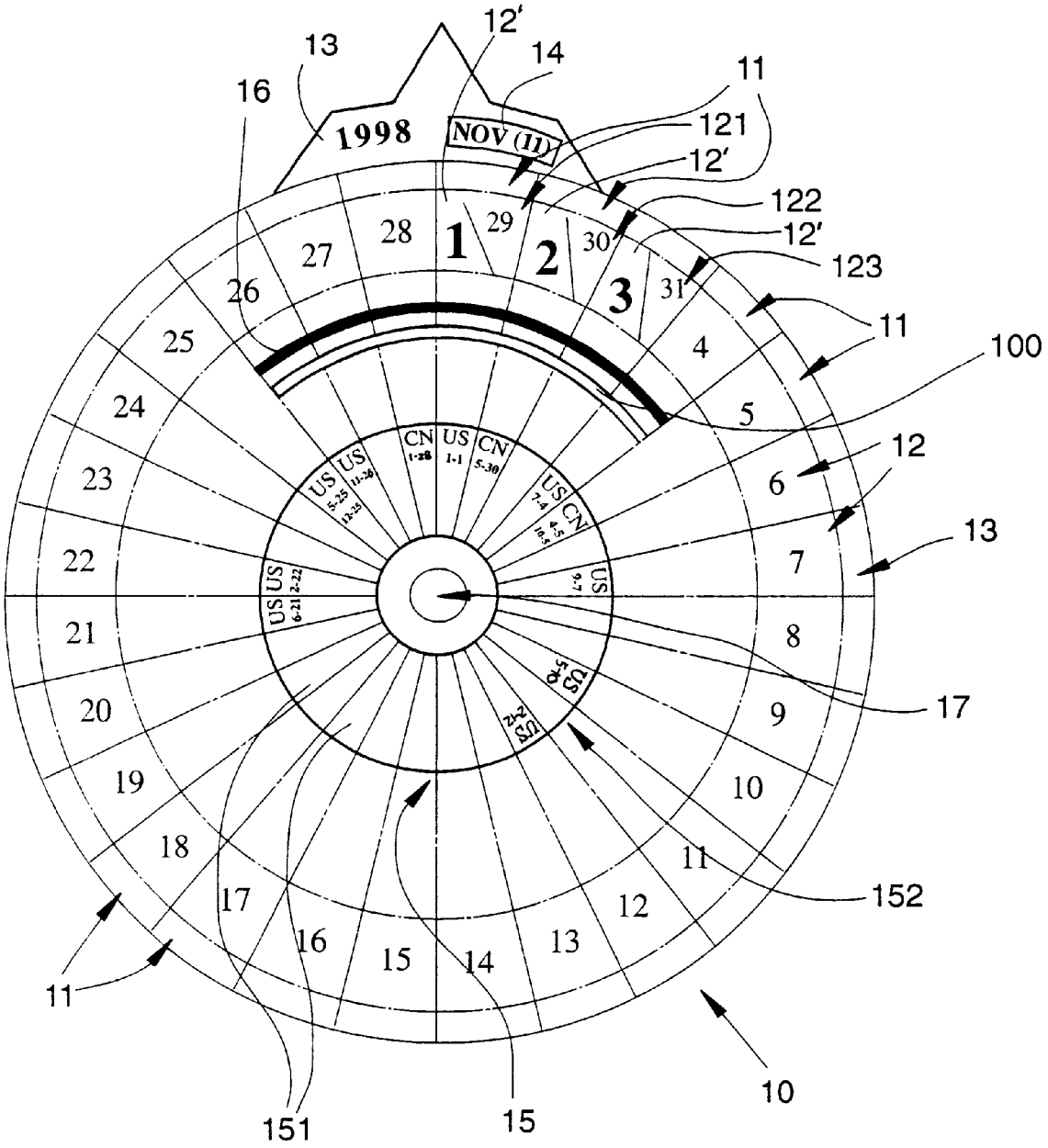
FIG. 2 is a front view of the date disc of the calendar indicator according to the above preferred embodiment of the present invention.
Figure 3:
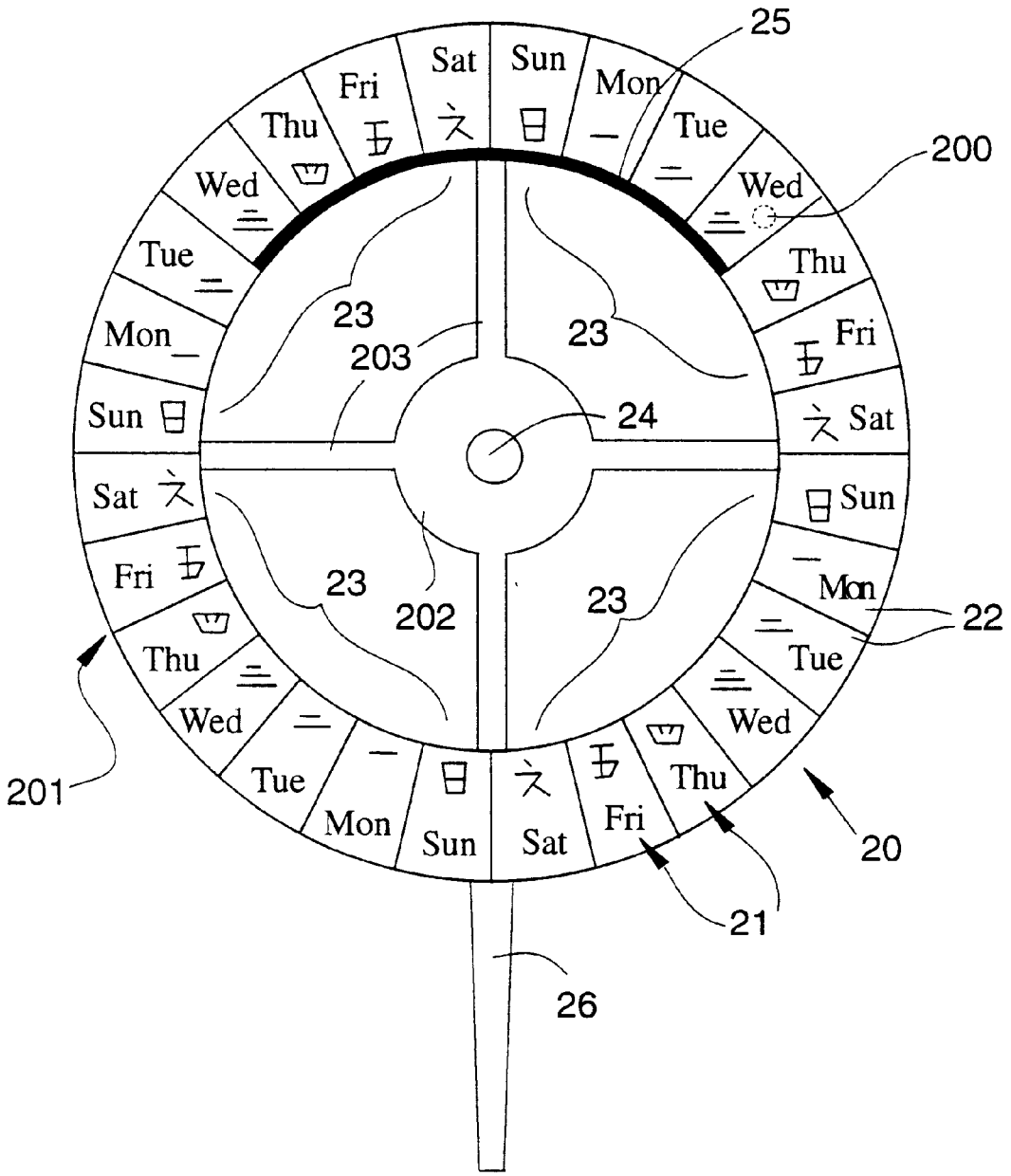
FIG. 3 is a front view of the week disc of the calendar indicator according to the above preferred embodiment.

Referring to FIGS. 1 to 3, a calendar indicator according to a preferred embodiment of the present invention is illustrated, which comprises a date disc 10, a week disc 20 which has a smaller diameter than the date disc 10 being coaxially and rotatably mounted on the date disc 10, and an indicator member 30 which is rotatably mounted on the week disc for indicating what date and day of week are today at the same time.

As shown in FIGS. 1 and 2, the date disc 10 is equally divided into 28 date sectors 11, wherein each of the date sectors 11 has an outer portion forming a date indicating segment 12. The date disc 10 further has 28 numerals, from "1" to "28", respectively provided in sequence on the 28 date indicating segments 12 of the 28 date sectors 11. The three adjacent date indicating segments 12' having the numerals "1", "2" and "3" provided thereon respectively form a first, a second and a third sub-segment 121, 122, 123. Three numerals including "29", "30" and "31" are respectively provided on the first, second and third sub-segments 1221, 122, 123. The date disc 10 further has a month indicator 13 extended therefrom for indicating a particular month of a year.

A month indicating sticker 14 is adhered on the month indicator 13 to indicate the current month. The manufacturers may provides twelve month indicating stickers 14 accompanied with the calendar indicator, wherein the 12 month indicating stickers 14 each has a particular month of a year (from "January" to "December") provided thereon. Therefore, at the beginning of each month within a year, the user may simply stick the respective month indicating sticker 14 on the month indicator 13 so as to clearly indicate the present month. The present year can also be indicated on the month indicator 13.

A central portion of the date disc 10 further has a circular special day indicating portion 15 which is also equally divided into 28 special day indicating segments 151. The 28 special day indicating segments 151 are respectively aligned with the 28 date indicating segments 12, wherein a plurality of indicating symbols 152 indicating the important holidays and festivals are respectively provided on the 28 special day indicating segments 151. Each of the indicating symbols 152 is arranged on the respective special day indicating segment 151 which is aligned with the respectively date indicating segment 12 indicating the date of the corresponding holiday or festival. For example, the independent day of United States is July 4, so that the corresponding indicating symbol 152 is indicated as "US 7-4", where the "US" representing United States and 7-4 representing July 4. The corresponding symbol 152 is provided on the respective special day indicating segment 151 aligned with the respective date indicating segment 12 having the numeral "4" provided thereon.

The date disc 10 further has a date adjustment strip 16 provided thereon, wherein the indicating strip 16 is extended below the seven neighboring date indicating segments 12 having the seven numerals "26", "27", "28", "1/29", "2/30", "3/13", and "4" provided thereon respectively. The indicating strip 16 is used for facilitating the adjustment of the week disc 20. Moreover, a central hole 17 is formed on the date disc 10 for rotatable connection with week disc 20 and the indicator member 30. Below the date adjustment strip 16, a guiding slot 100 is formed, which is extended across the seven neighboring date indicating segments 12 having the seven numerals "26", "27", "28", "1/29", "2/30", and "3/31".

As shown in FIGS. 1 and 3, the week disc 20 is equally divided into 28 week sectors 21 Each of the week sectors 21 has an outer portion forming a week indicating segment 22. In other words, 4 week segment sets 23 each containing seven adjacent week indicating segments 22 are provided. Seven days of a week, including "Sunday", "Monday", "Tuesday", "Wednesday", "Thursday", "Friday", and "Saturday", are respectively provided on the seven week indicating segments 22 of each of the week segment sets 23 by the symbols of "Sun", "Mon", "Tue", "Wed", "Thu", "Fri", and "Sat". The 28 date indicating segments 12 are aligned along a periphery edge of the week disc 20 with respect to the corresponding week indicating segments 22.

According to the preferred embodiment of the present invention, as shown in FIG. 3, the week disc 20 comprises an outer ring 201, a central supporting disc 202, and a plurality of supporting ribs 203 extended between the outer ring 201 and the central supporting disc 202. The 28 week indicating segments 22 are provided on the outer ring 201. A central connection hole 24 is provided on the central supporting disc 202 for rotatably connected with the date disc 10.

A week adjustment strip 25 is extended along a lower edge of seven neighboring week indicating segments 22 positioning on top of the week disc 20 and having "Thu" to "Wed" (representing Thursday to Wednesday) provided thereon respectively. It should be noted that the sequence of numerals on the date disc 10 and the weekdays on the week disc 20 must be in the same direction. For operation and adjustment purposes, an adjustment bar 26 is extended downwardly from the week disc 20. As shown in FIG. 1 the length of the adjustment bar 26 is arranged to enable a tip end 261 thereof protruding from a periphery edge of the date disc 10. The week disc 20 further has a guiding pin 200 protruded rearwardly adapted to pass through the guiding slot 100 of the date disc 10, so as to limit the turning angle of the week disc 20 within 90 degrees, i.e. between the seven week indicating segment 22 of one week segment set 23.

As shown in FIG. 1, the indicator member 30 is an indicator disc which has a central connecting hole 31 for rotatably and coaxially connecting with the week disc 20 and the date disc 10, an outer date indicating window 32 having a size equal to the size of the date indicating segment 12 of the date disc 10 so as to selectively enable one of the 28 date indicating segments 12 to be observed therethrough, an inner week indicating window 33 having a size equal to the size of the week indicating segment 22 of the week disc 20 so as to selectively enable one of the 28 week indicating segments 22 to be observed therethrough, wherein the week indicating window 33 is radially aligned with the date indicating window 32.

The indicator member 30 further comprises a turning means 34 for driving the indicator member 30 to rotate periodically for a sector distance. According to the preferred embodiment as shown in FIG. 1, the turning means 34 of the indicator member 30, i.e. the indicator disc, comprises a plurality of turner arcs 341 forming along the circumference of the indicator disc 30, so that the user can set the indicator disc 30 by rotating the indicator disc 30 by finger.

As shown in FIG. 1, a month-week reference chart 35 and a special day reference chart 36 are provided on an upper left side and an upper right side of the indicator disc 30 respectively. The month-week reference chart 35 indicates the day of week of the first day of each month within a year. The special day reference chart 37 indicates most of the important holidays and festivals in United States and/or other countries. For example, as shown in FIG. 1, the title, month and day of each special day is indicated in the special day reference chart 37. Other descriptions such as the operation manual instructing how to use and operate the calendar indicator of the present invention, and lunar calendar reference charts can be provided on the empty space on the indicator disc 30.

The calendar indicator of the present invention further comprises a holding member 40 which passes through the central connecting hole 31 of the indicator disc 30, the central connection hole 24 of the week disc 20 and the central hole 17 of the date disc 10 for rotatably holding the indicator disc 30, the week disc 20 and the date disc 10 together in overlapping manner, wherein the date disc 10 is positioned as a bottom layer, the week disc 20 is positioned as an intermediate layer and the indicator disc 30 is positioned as an uppermost layer. The indicator disc 30 is arranged to freely rotate with respect to the week disc 20 and the week disc 20 is arranged to freely rotate with respect to the date disc 10.

The indicator disc 30 substantially covers 27 date indicating segments 12 and 27 week indicating segments 22. Only a particular date indicating segment 121 and week indicating segment 22' will just locate at the date indicating window 32 and the week indicating window 33 respectively. Accordingly, the user simply need to rotate the indicator disc 30 for one sector distance every day, and then the date of today and the day of the week of that day are exposed and can be observed through the date indicating window 32 and the week indicating window 33 respectively. For example, if today is Nov. 1, 1998, then we can observe the numeral "1" in the date indicating segment 121 of the date indicating disc 10 though the date indicating window 32 of the indicator disc 30 and the "SUN" representing the weekday "Sunday" in the week indicating segment 22' of the week disc 20 through the week indicating window 33 of the indicator disc 30. Moreover, the week indicating window 33 is elongated downwardly to also expose the respective special day indicating segment 151 of that day, so that the user may also determine whether "today" is a holiday or festival by referencing the corresponding indicating symbol 152 in the special day indicating segment 151.

Furthermore, the date indicating window 32 must be large enough to show a portion of the date adjustment strip 16 and the week indicating window 33 must also be large enough to show a portion of the week adjustment strip 25. At the beginning of each month (for example November 1st, the numeral "1" will be observed through the date indicating window 32), the user may simply re-set the week disc 20 by rotating the week disc 20 by turning the tip end 261 of the adjustment bar 26. Referring to the month-week reference chart 35, we know that the day of week of November 1st is Sunday, so that the user may turn the week disc 20 until the correct week indicating segment 22 having "Sun" thereon is observed in the week indicating window 33. Since all the week symbols such as "Sun" to "Mon" are arranged in upright position on the 28 week indicating segments 22 respectively, in order to prevent any week symbol be rotated up-side down, the date and week adjustment strips 16 and 25 help the user to correctly adjust the week disc 20. In other words, both the date adjustment strip 16 and the week adjustment strip 25 should be always shown in the date indicating window 32 and the week indicating window 33 respectively during the adjustment in order to maintain all the week symbols be positioned in upright position.

Figure 4:
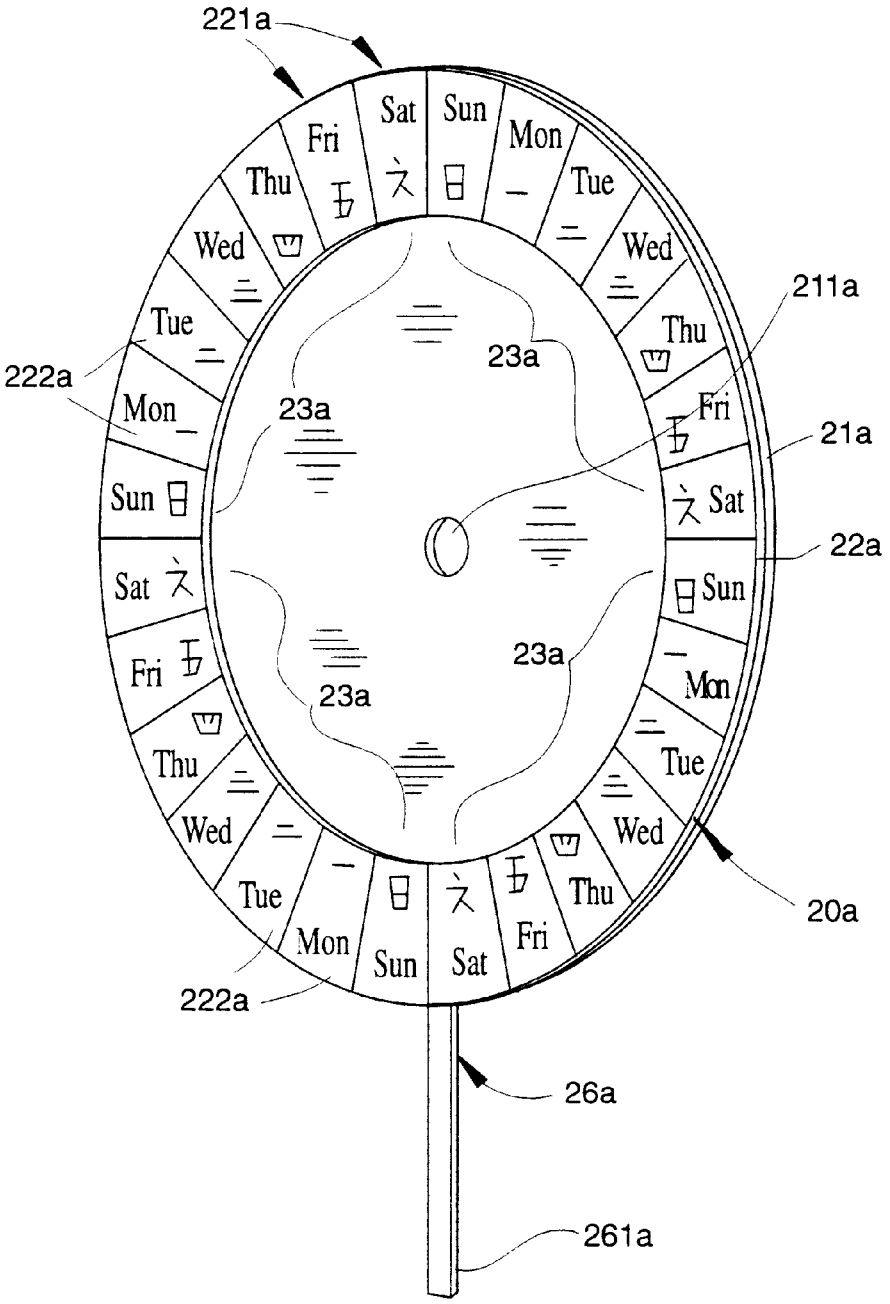
FIG. 4 is a perspective view of an alternative mode of the week disc of the calendar indicator according to the above preferred embodiment of the present invention.

Referring to FIG. 4, an alternative week disc 20*a* for substituting the week disc of the above preferred embodiment is illustrated. The alternative week disc 20*a* comprises a transparent supporting disc 21*a* made of plastic and a week indicating ring 22*a* affixed in front or behind the transparent supporting disc 21*a*. The transparent disc 21*a* has a central connecting hole 211*a* provided thereon for rotatably connecting between date disc 10 and the indicator member 20. Also, for operation and adjustment purposes, an adjustment bar 26*a* is extended downwardly from the transparent supporting disc 21*a*. Similarly, the length of the adjustment bar 26*a* is arranged to enable a tip end 261*a* thereof protruding from a periphery edge of the date disc 10. The week indicating ring 22*a* has an outer diameter equal to the diameter of the transparent supporting disc 21*a* which should be the same size of the week disc 20 as disclosed in the above preferred embodiment. The week indicating ring 22*a* is also divided into 28 week indicating segment 221*a*. In other words, 4 week segment sets 23*a* each containing seven adjacent week indicating segments 222*a* are provided. Seven days of a week, including "Sunday", "Monday", "Tuesday", "Wednesday", "Thursday", "Friday", and "Saturday", are respectively provided on the seven week indicating segments 221*a* of each of the week segment sets 23 by the symbols of "Sun", "Mon", "Tue", "Wed", "Thu", "Fri", and "Sat". As mentioned above, the week disc 20*a* is coaxially and rotatably mounted on the date disc 10. The 28 date indicating segments 12 are aligned along a periphery edge of the week disc 20*a* with respect to the corresponding week indicating segments 221*a*.

Figure 5:
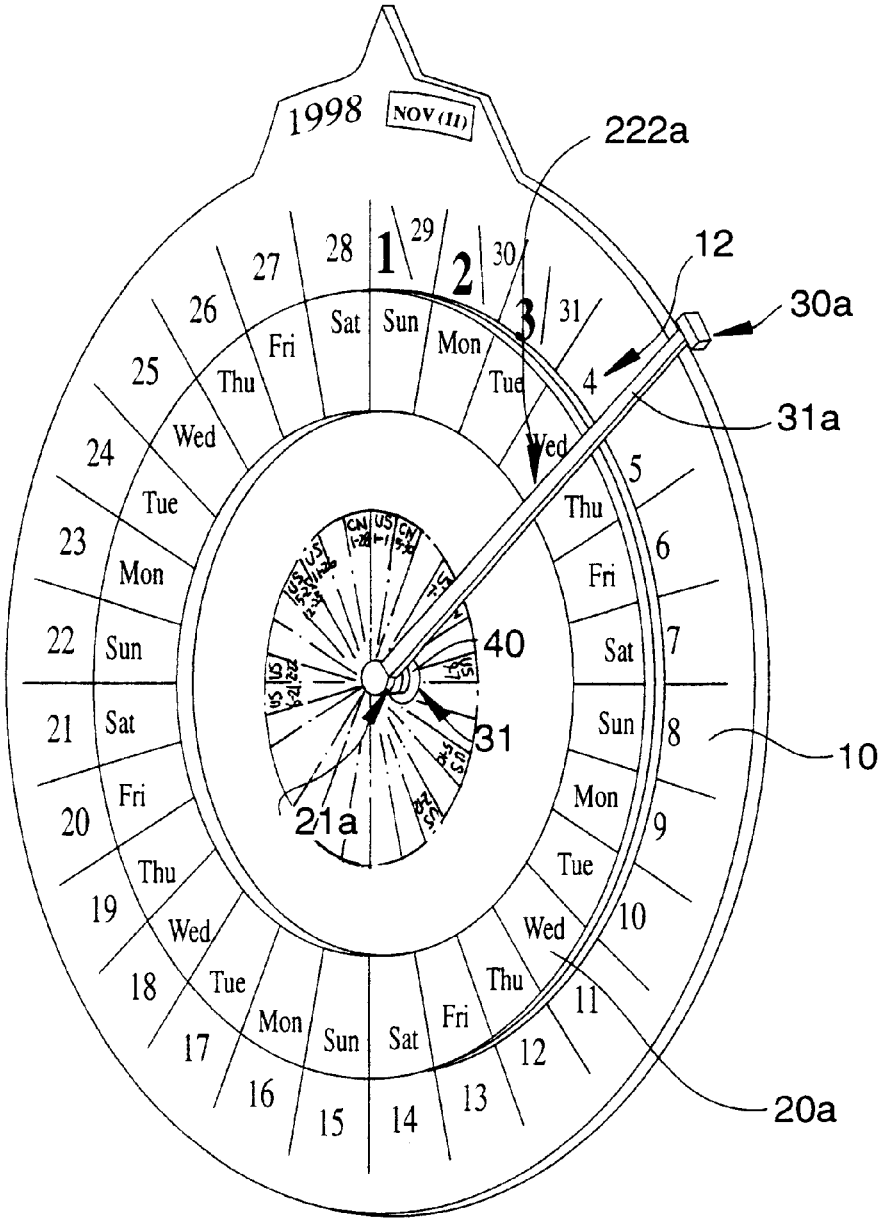
FIG. 5 is a perspective view illustrating an alternative mode of the indicating member of the calendar indicator according to the above preferred embodiment of the present invention.

As shown in FIG. 5, an alternative mode of the calendar indicator of the present invention is illustrated, wherein the date disc 10 and the alternative week disc 20*a* as shown in FIG. 4 are used to construct the calendar indicator. However, an alternative mode of the indicator member 30 is used. The alternative indicator member 30*a* as shown in FIG. 5 comprises an indicating arm 31*a* that preferably has a length longer than a radius of the date disc 10. The indicating arm 31*a* is rotatably mounted on the alternative week disc 20*a* by rotatably connecting to the holding member 40 which merely passes through the central connection hole 221*a* of the alternative week disc 20*a* and the central hole 31 of the indicator disc 30 for rotatably holding the alternative week disc 20*a* and the date disc 10 together in overlapping manner. The user may simply turn the indicator arm 31*a* to a position in front of the respective date and week indicating segments 12, 221*a* to indicate the current date and day of week of today.

It is worth to mention that the basic design concept of the calendar indicator of the present invention successfully solve the conflicting facts, i.e. there are seven days a week but there are 28, 30 or 31 days a month. In other words, except the February, there are more than four weeks within a month. For January, March, May, July, September, November, there are 3 days more than 4 weeks (28 days). Moreover, for April, June, August, October, and December, there are 2 days more than the 28 days in four weeks. In view of the difference between the varying number of days in each month within a year and the 28 days in four weeks, four week segment sets 23 are circularly provided on the week disc 20 to define 28 week indicating segments 22. Furthermore, the date disc 10 is only divided into 28 date sectors 11 to totally define 28 date indicating segments 12. Accordingly, each of the 28 date indicating segments 12 can be aligned with a respective week indicating segment 22. The exceeding dates, including "29", "30" and "31", alternatively shares three date indicating segments 121, 122, 123 having the numerals "1", "2" and "3" thereon. Therefore, no matter the totally days of a month has 28, 29, 30, and 31 days, the calendar indicator of the present invention can indicate the respective day of week correspondingly.

Figure 6:
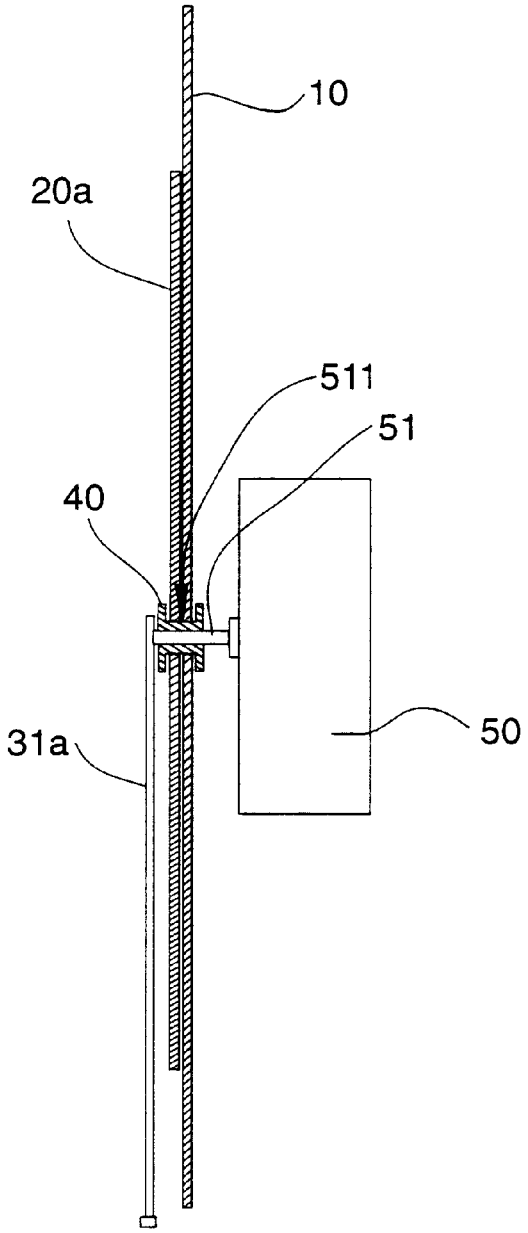
FIG. 6 is a sectional view of the calendar indicator as shown in FIG. 5 incorporating with a time equipment according to the above preferred embodiment of the present invention.

The calendar indicator may also equipped with a time equipment 50 which is adapted for automatically driving the indicator member 30*a* to move for 1/28 circle every day. For example, as shown in FIG. 6, the time equipment 50 is equipped with the alternative mode of the calendar indicator. The time equipment 50 is a movement adapted to drive a time axle 51 connected thereto to rotate 1/28 circle per day. The time equipment 50 is mounted behind the date disc 10. The time axle 51 of the time equipment 50 penetrates through a through hole 511 of the holding member 40 to connect with indicator arm 31*a* so as to drive the indicator arm 31*a* to automatically rotate 1/28 circle per day. Therefore, the indicator arm 31*a* can automatically move from one date indicating segment 12 to another neighboring date indicating segment 12 in clockwise direction every day.

Figure 7:
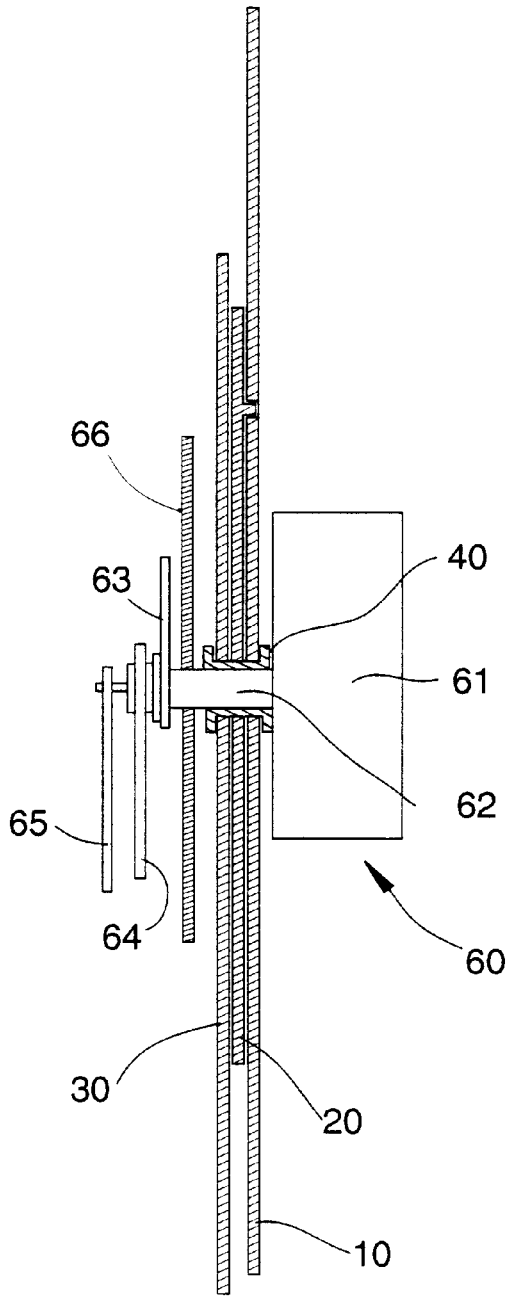
FIG. 7 is a sectional view of the calendar indicator equipped with a clock according to the above preferred embodiment of the present invention.

As shown in FIG. 7, the calendar indicator may also equipped with a clock 60 so as to indicate the current time at the same time. The clock 60 comprises a clock movement 61 mounted behind the date disc 10, a driving axle 62 extending through the holding member 40 to connect with a hour hand 63, a minute hand 64 and a second hand 65 in front of the indicator disc 30, and a dial 66 which s affixed between the indicator disc 30 and the hour hand 63. Therefore, the user may observe the current time as well as the information of what day is today at the same time.

What is claimed is:

1. A calendar indicator, comprising a date disc equally divided into 28 date sectors, each of said date sectors having an outer portion forming a date indicating segment, said date disc further having 28 numerals, from "1" to "28", respectively provided in sequence on said 28 date indicating segments of said 28 date sectors, three of said 28 date indicating segments having said numerals "1", "2" and "3" provided thereon respectively form a first, a second and a third sub-segment respectively, wherein three numerals including "29", "30" and "31" are respectively provided on said first, second and third sub-segments, said date disc further having a month indicator extended therefrom for indicating a particular month of a year;

a week disc which has a smaller diameter than said date disc being coaxially and rotatably mounted on said date disc, said week disc being equally divided into 28 week sectors, each of said week sectors having an outer portion forming a week indicating segment, so as to define week segment sets that each contains seven of said week indicating segments, wherein seven days of a week, including "Sunday", "Monday", "Tuesday", "Wednesday", "Thursday", "Friday", and "Saturday", are respectively provided on said seven week indicating segments of each of said week segment sets by symbols of "Sun", "Mon", "Tue", "Wed", "Thu", "Fri", and "Sat", wherein said 28 date indicating segments are aligned a long a periphery edge of said week disc with respect to said corresponding week indicating segments, wherein an adjustment bar is extended from a periphery of said week disc until a tip end thereof protruding from a periphery edge of said date disc for rotating said week disc;

an indicator member which is rotatably mounted on said week disc for indicating what date and day of week are today at s aid same time; and means for limiting the turning angle of said week disc within 90 degrees, that is between said seven week indicating segment of one of said week segment sets, thereby at a beginning of each month, said week disc is capable of being reset by rotating said week disc by turning said tip end of said adjustment bar.

2. A calendar indicator, as defined in claim 1, wherein s aid week disc comprises an outer ring, a central supporting disc, and a plurality of supporting ribs extended between said outer ring and said central supporting disc, said 28 week indicating segments are provided on said outer ring, said central supporting disc having a central connection hole provided thereon for rotatably connected with said date disc.

3. A calendar indicator, as defined in claim 1, wherein said week disc comprises a transparent supporting disc and a week indicating ring affixed to said transparent supporting disc, said transparent disc having a central connecting hole provided thereon for rotatably connecting between date disc and said indicator member, wherein said week indicating ring has an outer diameter equal to a diameter of said transparent supporting disc, and that said 28 week indicating segments are provided on said week indicating ring.

4. A calendar indicator, as defined in claim 2, wherein said indicator member is an indicator disc having a central connecting hole for rotatably and coaxially connecting with said week disc and said date disc, an outer date indicating window having a size equal to a size of said date indicating segment of said date disc so as to selectively enable one of said 28 date indicating segments to be observed therethrough, an inner week indicating window having a size at least equal to a size of said week indicating segment of said week disc so as to selectively enable one of said 28 week indicating segments to be observed therethrough, said week indicating window being radially aligned with said date indicating window, said indicator member further comprising a turning means for driving said indicator member to rotate a sector distance per day.

5. A calendar indicator, as defined in claim 3, wherein said indicator member is an indicator disc having a central connecting hole for rotatably and coaxially connecting with said week disc and said date disc, an outer date indicating window having a size equal to a size of said date indicating segment of said date disc so as to selectively enable one of said 28 date indicating segments to be observed therethrough, an inner week indicating window having a size at least equal to a size of said week indicating segment of said week disc so as to selectively enable one of said 28 week indicating segments to be observed therethrough, wherein said week indicating window is radially aligned with said date indicating window.

6. A calendar indicator, as defined in claim 5, wherein said turning means of said indicator member comprises a plurality of turner arcs forming along a circumference of said indicator disc.

7. A calendar indicator, as defined in claim 4, further comprises a holding member which passes through said central connecting hole of said indicator member, said central connection hole of said week disc and a central hole of said date disc for rotatably holding said indicator member, said week disc and said date disc together in overlapping manner, wherein said date disc is positioned as a bottom layer, said week disc is positioned as an intermediate layer and said indicator disc is positioned as an uppermost layer.

8. A calendar indicator, as defined in claim 5, further comprises a holding member which passes through said central connecting hole of said indicator member, said central connection hole of said week disc and a central hole of said date disc for rotatably holding said indicator member, said week disc and said date disc together in overlapping manner, wherein said date disc is positioned as a bottom layer, said week disc is positioned as an intermediate layer and said indicator disc is positioned as an uppermost layer.

9. A calendar indicator, as defined in claim 7, wherein a central portion of said date disc further has a circular special day indicating portion which is also equally divided into 28 special day indicating segments, said 28 special day indicating segments being respectively aligned with said 28 date indicating segments, a plurality of indicating symbols indicating important holidays and festivals being respectively provided on said 28 special day indicating segments, each of said indicating symbols being arranged on said respective special day indicating segment which is aligned with said respectively date indicating segment indicating that date of said corresponding holiday or festival, wherein said week indicating window is large enough to show said corresponding special day indicating segments.

10. A calendar indicator, as defined in claim 8, wherein a central portion of said date disc further has a circular special day indicating portion which is also equally divided into 28 special day indicating segments, said 28 special day indicating segments being respectively aligned with said 28 date indicating segments, a plurality of indicating symbols indicating important holidays and festivals being respectively provided on said 28 special day indicating segments, each of said indicating symbols being arranged on said respective special day indicating segment which is aligned with said respectively date indicating segment indicating that date of said corresponding holiday or festival, wherein said week indicating window is large enough to show said corresponding special day indicating segments.

11. A calendar indicator, as defined in claim 9, wherein a month-week reference chart and a special day reference chart are provided on said indicator member respectively, said month-week reference chart indicating the day of week of the first day of each month in year, said special day reference chart indicating important holidays and festivals.

12. A calendar indicator, as defined in claim 10, wherein a month-week reference chart and a special day reference chart are provided on said indicator member respectively, said month-week reference chart indicating the day of week of the first day of each month in year, said special day reference chart indicating important holidays and festivals.

13. A calendar indicator, as defined in claim 1, wherein a month indicating sticker is adhered on said month indicator to indicate the current month.

14. A calendar indicator, as defined in claim 11, wherein said date disc further has a date adjustment strip provided thereon, said indicating strip being extended below said seven neighboring date indicating segments having said seven numerals "26", "27", "28", "1/29", "2/30", "3/31", and "4" provided thereon respectively, a week adjustment strip being extended along a lower edge of seven of said week indicating segments positioning on top of said week disc and having "Thu" to "Wed" representing Thursday to Wednesday provided thereon respectively, wherein said date indicating window is large enough to show a portion of said date adjustment strip and said week indicating window is large enough to show a portion of said week adjustment strip.

15. A calendar indicator, as defined in claim 12, wherein said date disc further has a date adjustment strip provided thereon, said indicating strip being extended below said seven neighboring date indicating segments having said seven numerals "26", "27", "28", "1/29", "2/30", "3/31", and "4" provided thereon respectively, a week adjustment strip being extended along a lower edge of seven of said week indicating segments positioning on top of said week disc and having "Thu" to "Wed" representing Thursday to Wednesday provided thereon respectively, wherein said date indicating window is large enough to show a portion of said date adjustment strip and said week indicating window is large enough to show a portion of said week adjustment strip.

16. A calendar indicator, as defined in claim 1, wherein said limiting means comprises a guiding pin protruding rearwardly from said week disc to pass through a guiding slot formed on said date disc, wherein said guiding slot is extended along seven of said date indicating segments for limiting the rotating angle of said week disc.

17. A calendar indicator, as defined in claim 8, wherein said limiting means comprises a guiding pin protruding rearwardly from said week disc to pass through a guiding slot formed on said date disc, wherein said guiding slot is extended along seven of said date indicating segments for limiting the rotating angle of said week disc.

18. A calendar indicator, as defined in claim 1, wherein said indicator member comprises an indicating arm having a length longer than a radius of said date disc, said indicating arm being rotatably mounted on said week disc by rotatably connecting to a holding member which merely passes through said central connection hole of said week disc and a central hole of said indicator disc for rotatably holding said week disc and said date disc together in overlapping manner.

19. A calendar indicator, as defined in claim 8, wherein said indicator member comprises an indicating arm having a length longer than a radius of said date disc, said indicating arm being rotatably mounted on said week disc by rotatably connecting to said holding member.

20. A calendar indicator, as defined in claim 1, further comprising a time equipment for automatically driving said indicator member to move for 1/28 circle every day.

21. A calendar indicator, as defined in claim 18, further comprising a time equipment which is a movement adapted to drive a time axle connected thereto to rotate 1/28 circle per day, wherein said time equipment is mounted behind said date disc, said time axle of said time equipment penetrating through a through hole of said holding member to connect with said indicator arm so as to drive said indicator arm to automatically rotate 1/28 circle per day.

22. A calendar indicator, as defined in claim 1, further comprising a clock which comprises a clock movement mounted behind said date disc, a driving axle extending coaxially through said date disc, week disc and said indicator member to connect with a hour hand, a minute hand and a second hand in front of said indicator member, and a dial affixed between said indicator member and said hour hand.

* * * * *